US010871299B2

(12) United States Patent
Dearing et al.

(10) Patent No.: US 10,871,299 B2
(45) Date of Patent: Dec. 22, 2020

(54) AIR SYSTEM

(71) Applicant: UNITED COOLAIR CORPORATION, York, PA (US)

(72) Inventors: David B. Dearing, Lancaster, PA (US); Andrew Abel, Wrightsville, PA (US)

(73) Assignee: UNITED COOLAIR CORPORATION, York, PA (US)

( * ) Notice: Subject to any disclaimer, the term of this patent is extended or adjusted under 35 U.S.C. 154(b) by 255 days.

(21) Appl. No.: 16/207,711

(22) Filed: Dec. 3, 2018

(65) Prior Publication Data

US 2019/0170379 A1 Jun. 6, 2019

Related U.S. Application Data

(60) Provisional application No. 62/594,321, filed on Dec. 4, 2017.

(51) Int. Cl.
*F24F 11/30* (2018.01)
*F25B 1/053* (2006.01)
(Continued)

(52) U.S. Cl.
CPC ..... *F24F 11/30* (2018.01); *F24F 11/72* (2018.01); *F24F 11/81* (2018.01); *F24F 11/86* (2018.01); *F25B 1/053* (2013.01); *F25B 13/00* (2013.01); *F24F 2011/0002* (2013.01); *F24F 2110/10* (2018.01); *F24F 2110/12* (2018.01); *F24F 2221/17* (2013.01); *F24F 2221/50* (2013.01);
(Continued)

(58) Field of Classification Search
CPC .. F24F 11/30; F24F 11/72; F24F 11/81; F24F 11/86; F24F 2221/50; F24F 2221/17; F24F 2011/0002; F24F 2110/10; F24F 2110/12; F25B 1/053; F25B 13/00; F25B 2313/0314; F25B 2400/06; F25B 2600/2509; F25B 2313/009
See application file for complete search history.

(56) References Cited

U.S. PATENT DOCUMENTS 5,024,263 A * 6/1991 Laine ..... F24F 13/15 165/283
7,231,967 B2 * 6/2007 Haglid ..... B25B 27/0042 165/231
(Continued)

*Primary Examiner* — Emmanuel E Duke
(74) *Attorney, Agent, or Firm* — McNees Wallace & Nurick LLC

(57) ABSTRACT

An air system includes an enclosure. A compressor, a first energy exchange device, an expansion device, and a second energy exchange device are each positioned in or along the enclosure and connected in a closed refrigerant loop. A first inlet receives air being psychrometrically controlled in the enclosure from a first source. A first outlet removes the psychrometrically controlled air from the enclosure. A second inlet receives air being non-psychrometrically controlled in the enclosure from a second source. A second outlet removes the non-psychrometrically controlled air from the enclosure. A third energy exchange device positioned in or along the enclosure exchanges energy between the psychrometrically controlled air and the non-psychrometrically controlled air. The enclosure is adapted for insertion through an opening having opposed parallel sides having a dimension of 36 inches or less.

17 Claims, 8 Drawing Sheets

(51) Int. Cl.

| | |
|---|---|
| ***F25B 13/00*** | (2006.01) |
| ***F24F 11/72*** | (2018.01) |
| ***F24F 11/81*** | (2018.01) |
| ***F24F 11/86*** | (2018.01) |
| *F24F 11/00* | (2018.01) |
| *F24F 110/10* | (2018.01) |
| *F24F 110/12* | (2018.01) |

(52) U.S. Cl.
CPC . *F25B 2313/009* (2013.01); *F25B 2313/0314* (2013.01); *F25B 2400/06* (2013.01); *F25B 2600/2509* (2013.01)

(56) References Cited

U.S. PATENT DOCUMENTS

| | | | | |
|---|---|---|---|---|
| 9,395,097 | B2 * | 7/2016 | McKie | F24F 13/30 |
| 2010/0170655 | A1 * | 7/2010 | Kronvall | F24F 12/006 165/59 |
| 2014/0262125 | A1 * | 9/2014 | Erb | F28D 9/0062 165/10 |

* cited by examiner

AIR SYSTEM

FIELD OF THE INVENTION

The present invention is directed to the field of air systems for heating, ventilating, and/or air-conditioning (HVAC) system, and, in particular, for dedicated outdoor air systems.

BACKGROUND OF THE INVENTION

It is known that the air outside of buildings is generally healthier for human respiration than the air inside of buildings. But humans are most comfortable in somewhat neutral air conditions of temperature and humidity that are not found in the outside environment in which humans choose to live. It is possible to introduce or duct in outside air to the inside of a building or enclosure, with energy then needing to be expended to condition the air to the proper temperature and humidity. Based on the amount and type of human activity, more or less outside air is required to satisfy the ventilation need. To solve this problem, the HVAC market has responded with modifications of traditional equipment meant to recondition recirculated indoor air. These solutions are either packaged (self-contained) and large (both cabinet volume and footprint) for a particular quantity of air being conditioned and/or the amount of energy being removed from the air for cooling or added to the air for heating, and require exterior mounting, such as on a roof, or if they are smaller, containing components that are meant to use less interior building volume/space but split, needing separate remotely located components that require field layout and connections. Due to traditional manufacturing processes, these units are assembled in such a way that one of the major serviceable components, such as a compressor, requires skilled labor in a fire-hazard situation to be serviced. To improve the overall safety of this process, various codes have been developed to require certain protocols be followed. Compliance with these codes may require what is sometimes referred to as a "hot work permit." For example, when working on a compressor in a municipal building, the permit might require the presence of two knowledgeable persons, with a fire extinguisher, including appropriate documentation as to the day and time of work. Another problem is that the outside conditions change with time and location. There is a benefit in having the HVAC equipment handling this ventilation air to be able to adapt in some way to changes in some combination of input conditions and customer requirements, and be able to measure, with some reasonable accuracy, the amount of air being brought into the equipment. At the same time, a combination of various efficiency codes has been developed to aid in standardizing and enforcing the commercial HVAC market's response to the outside air ventilation need. Similar to miles-per-gallon for automobiles, these metrics aim to make equipment produce a certain beneficial effect with minimal energy use. Lastly, having that same piece of equipment both heat the incoming air in winter and cool the incoming air in summer without auxiliary inputs, such as electric heaters, has been a problem for some time, as the outside air has a much larger swing in temperature than the air that stays in the building.

There is a need in the art for an air system that does not suffer from these deficiencies.

SUMMARY OF THE INVENTION

In an embodiment, an air system includes an enclosure. The air system further includes a compressor, a first energy exchange device, an expansion device, and a second energy exchange device each positioned in or along the enclosure and connected in a closed refrigerant loop. The air system further includes a first inlet formed in the enclosure for receiving air from a first source, the air received from the first source being psychrometrically controlled in the enclosure. The air system further includes a first outlet formed in the enclosure for removing the psychrometrically controlled air from the enclosure. The air system further includes a second inlet formed in the enclosure for receiving air from a second source, the air received from the second source being non-psychrometrically controlled in the enclosure. The air system further includes a second outlet formed in the enclosure for removing the non-psychrometrically controlled air from the enclosure. The air system further includes a third energy exchange device positioned in or along the enclosure for exchanging energy between the psychrometrically controlled air and the non-psychrometrically controlled air. The enclosure is adapted for insertion through an opening having opposed parallel sides having a dimension of 36 inches or less.

In another embodiment, an air system includes an enclosure. The air system further includes a compressor, a first energy exchange device, an expansion device, and a second energy exchange device each positioned in or along the enclosure and connected in a closed refrigerant loop. The air system further includes a first inlet formed in the enclosure for receiving air from a first source, the air received from the first source being psychrometrically controlled in the enclosure. The air system further includes a first outlet formed in the enclosure for removing the psychrometrically controlled air from the enclosure. The air system further includes a second inlet formed in the enclosure for receiving air from a second source, the air received from the second source being non-psychrometrically controlled in the enclosure. The air system further includes a second outlet formed in the enclosure for removing the non-psychrometrically controlled air from the enclosure. The air system further includes a third energy exchange device positioned in or along the enclosure for exchanging energy between the psychrometrically controlled air and the non-psychrometrically controlled air. The air system further includes the enclosure having a cross section having outside dimensions of less than 36 inches in two perpendicular directions.

In a further embodiment, a compressor includes a first fitting connected to a first pressure port of the compressor or to one end of a first tube connected to the first pressure port, and a second fitting connected to a second pressure port of the compressor or to one end of a second tube connected to the second pressure port. The compressor further includes the first fitting and the second fitting being threadedly engageable with a corresponding first fitting to form a first fitting pair, and a second fitting pair, respectively, the corresponding first fitting and corresponding second fitting being in fluid communication with a closed refrigerant loop, the first fittings of the first fitting pair and the second fittings of the second fitting pair each being adapted to be repeatably threadedly disconnected from one another. In response to each instance of the first fitting and the corresponding first fitting of the first fitting pair and the second fitting and the corresponding second fitting of the second fitting pair being threadedly disconnected from one another, each first fitting, corresponding first fitting, second fitting, and corresponding second fitting forming a fluid tight seal preventing refrigerant flow therethrough.

Other features and advantages of the present invention will be apparent from the following more detailed description, taken in conjunction with the accompanying drawings which illustrate, by way of example, the principles of the invention. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present application. Also, common but well-understood elements that are useful or necessary in a commercially feasible embodiment are typically not depicted in order to facilitate a less obstructed view of these various embodiments of the present application.

BRIEF DESCRIPTION OF THE DRAWINGS

Wherever possible, the same reference numbers will be used throughout the drawings to represent the same parts.

DETAILED DESCRIPTION OF THE INVENTION

Figure 1:
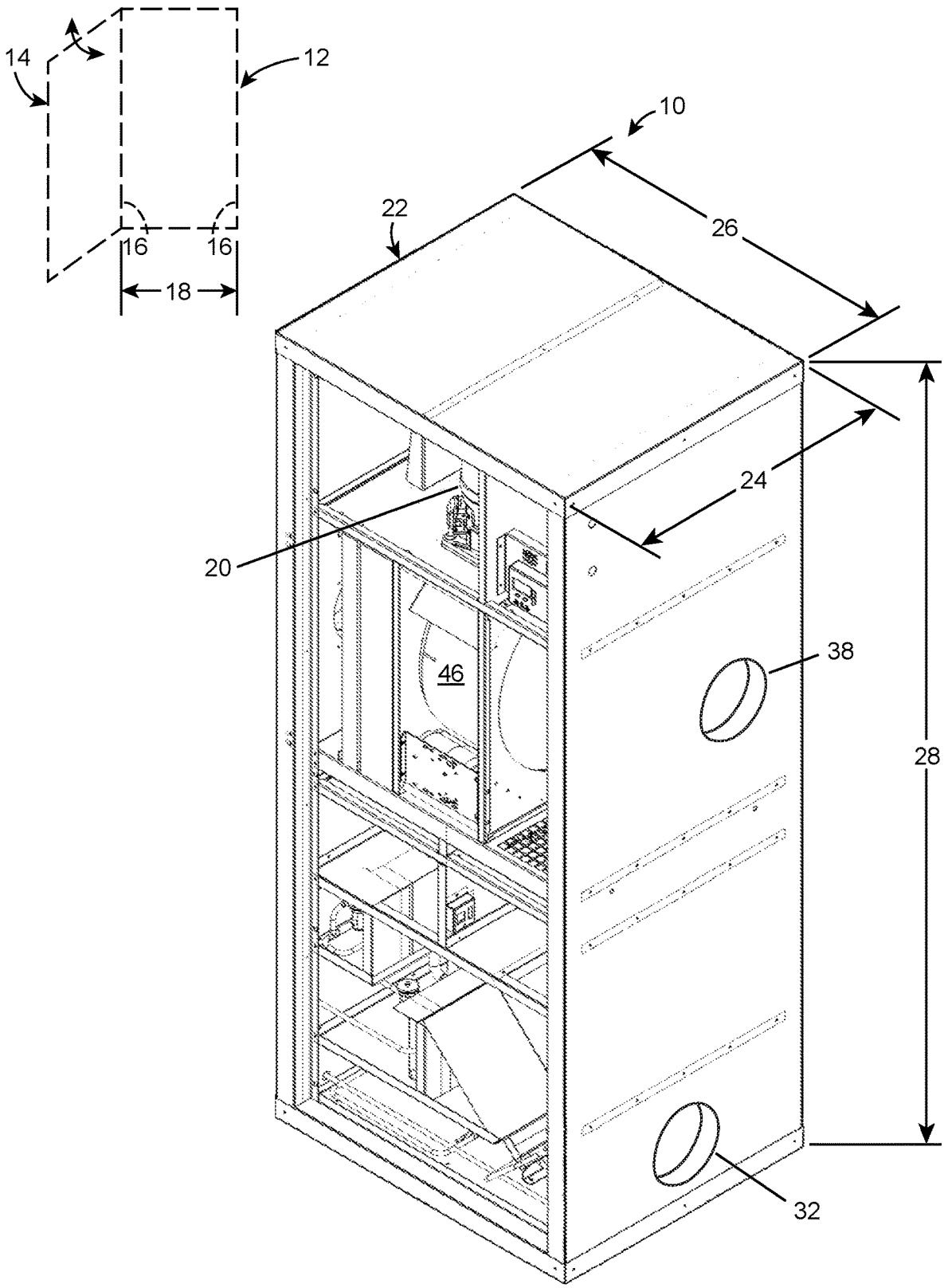
FIG. 1 is an upper perspective view of an exemplary air system.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top," and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

As shown in FIG. 1, an exemplary embodiment an air system 10 of the present invention is both small and packaged (self-contained), meaning that it is, without disassembly, able to be moved through or adapted for insertion through opening 12 such as standard doorways having a door 14, which doorways having opposed parallel sides 16 and installed inside of buildings in, for example, drop-ceilings, rather than on a roof. In one embodiment, the air system may be configured for outdoor installation. Stated another way, air system 10 that includes components secured in or along a unit or enclosure 22, without disassembly, is sufficiently compact for insertion through openings 12 having opposed parallel sides 16 separated by or having a dimension 18 of 36 inches or less.

This compact construction is especially beneficial for buildings with minimal roof space, such as high-rise buildings. This unit or air system 10 is also packaged. That is, an installer does not need to layout and field assemble different components, such as field refrigerant lines or tubes extending between sections, typically involving two electrical hook-ups, two condensation hook-ups, and/or two separate installations (e.g., removing ceiling tiles, etc.) for a conventional unit having separately located condenser and evaporator sections, sometimes referred to as a "split" unit. Another solution this air system 10 offers is that the major serviceable component, such as a compressor 20 is replaceable without needing a "hot work permit." This is accomplished by a specific piping layout with valves that manages or controls the flow of refrigerant. The air flow measurement conundrum is solved via utilizing a physical phenomenon of the air through a certain device within the cabinet or enclosure that allows the air flow to be easily and accurately correlated with simple tools commonly carried by field technicians, or, alternatively, measured and controlled by building management systems. The efficiency problem is solved in part by the arrangement of devices within the unit or air system, the order of which the air must pass through, and refrigeration management using certain valves and thermodynamic processes utilized in vapor compression refrigeration systems. This also allows the unit or air system to heat and cool incoming outside air without the need for auxiliary heating devices over a wider range of natural conditions compared to other air systems presently in the market.

Figure 2:
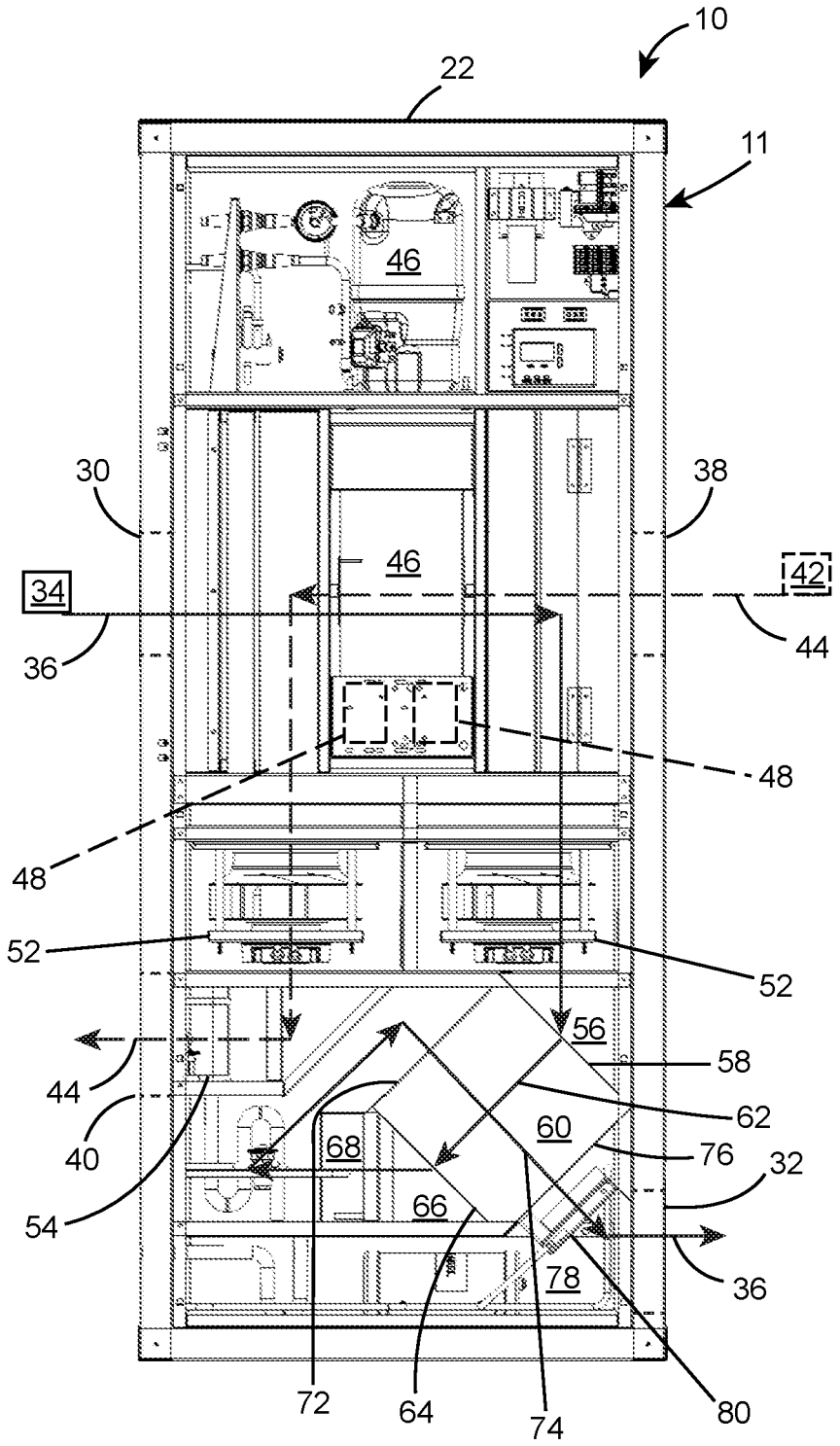
FIG. 2 is an elevation view of the air system of FIG. 1.

As shown in FIG. 1, air system 10 includes a compact enclosure 22 having outside or exterior dimensions 24, 26, 28 extending in mutually perpendicular directions. In one embodiment, at least one of outside or exterior dimensions 24, 26, 28 may not extend perpendicularly relative to the direction of at least one of the other dimensions. In other words, in one embodiment, enclosure 22 may have any shape. In one embodiment, dimension 24 measures 36 inches or less in length. In one embodiment, dimensions 24, 26 each measure 36 inches or less in length. In one embodiment, dimensions 24, 26 each measure less than 36 inches in length. In one embodiment, dimensions 24, 26 each measure 36 inches or less in length and are mutually perpendicular to one another. As shown in FIG. 2, enclosure 22 includes an inlet 30 for receiving air 36 to be psychrometrically controlled from an air source 34, which air 36 being removed from enclosure 22 via an outlet 32. Enclosure 22 further includes an inlet 38 for receiving air 44 that is non-psychrometrically controlled from an air source 42, which air 44 being removed from enclosure 22 via an outlet 40.

For purposes herein, the term "psychrometrically controlled" means that parameters such as humidity and temperature are to be controlled for air 36, for purposes such as being introduced in a structure (not shown) for climate control within the structure. That is, the humidity and temperature of air 36 exiting enclosure 22 via the outlet 32 is controlled more tightly compared to the range of humidity and temperature of air 36 of air entering enclosure 22 from source 34.

For purposes herein, the term "non-psychrometrically controlled" means that parameters such as humidity and temperature are not to be controlled. That is, although air 44 is utilized to exchange energy or energy and moisture with air 36, it is not an object of the invention to control the humidity or the temperature of air 44 exiting enclosure 22 via outlet 40, but for air system 10 to efficiently exchange energy or energy and moisture between air 44 with air 36 so that air 36 exits enclosure 22 via outlet 32 at a desired humidity and temperature.

For purposes herein, the terms "psychrometrically controlled air 36" and "air 36" and the like may be used interchangeably.

For purposes herein, the terms "non-psychrometrically controlled air 44" and "air 44" and the like may be used interchangeably.

It is to be understood that components, including refrigerant lines or tubes deliverable as part of the assembled enclosure may be secured in or along enclosure 22, such as extending along the exterior of the enclosure, such as extending outside of the enclosure dimensions 24, 26, 28, so long as enclosure 22 may be inserted through opening 12 (FIG. 1) without requiring disassembly of these components from the enclosure prior to such insertion.

Figure 3:
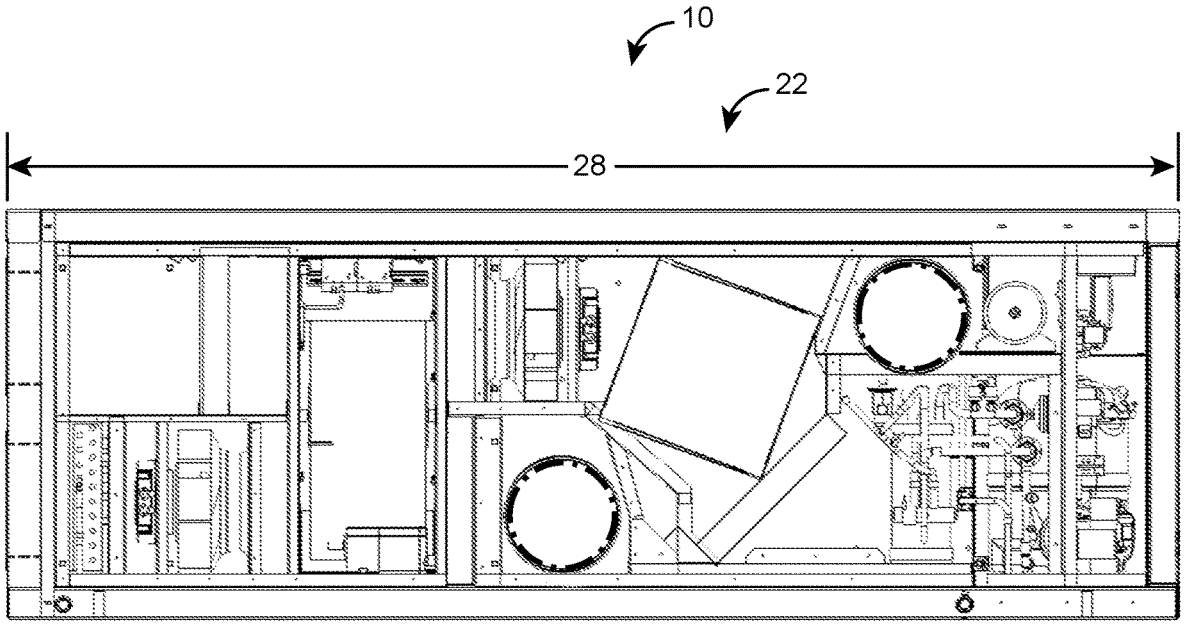
FIG. 3 is an elevation view of an exemplary air system.

As further shown in FIG. 2, psychrometrically controlled air 36 enters enclosure 22 via inlet 30 and non-psychrometrically controlled air 44 enters enclosure 22 via inlet 38 in a direction opposite psychrometrically controlled air 36. The counterflowing streams of psychrometrically controlled air 36 and non-psychrometrically controlled air 44 exchange energy in energy exchange device 46. In one embodiment, energy exchange device 46 is an energy recovery wheel such as a sensible wheel, for exchanging sensible energy as a result of the temperature differences between the wheel and the air 36, 44 flowing through the wheel. If the wheel is coated with a desiccant material, defining an enthalpy wheel, latent energy may also be exchanged between psychrometrically controlled air 36 and non-psychrometrically controlled air 44. Therefore, in one embodiment, energy exchange device 46 may exchange both sensible and latent energy, such as with an enthalpy wheel, and in another embodiment, energy exchange device 46 may exchange only sensible energy, such as with a sensible wheel. In one embodiment, energy exchange device is a heat pipe. FIG. 3 shows an embodiment of air system 10 that is similar to FIGS. 1 and 2, but permits installation in a different orientation, such as dimension 28. That is, the air system 10 arrangement shown in FIGS. 1 and 2 are configured such that dimension 28 extends in a vertical direction, while in FIG. 3, dimension 28 extends in a horizontal direction, e.g., installation in a drop-ceiling. In one embodiment, air system 10 may be configured such that dimension 28 extends in any direction between vertical and horizontal.

As further shown in FIG. 2, optionally, one or more sensors 48 measure the pressure drop or difference through energy exchange device 46 for each of psychrometrically controlled air 36 and non-psychrometrically controlled air 44, outputting an output voltage in a well-known manner. A. For example, a single sensor 48, such as a diaphragm sensor directly measures the pressure difference between two predetermined locations of air 36 or air 44 relative to energy exchange device 46, versus at least two sensors 48, in which each sensor 48 of the at least two sensors 48 measures a pressure at a predetermined location of air 36 or air 44 relative to energy exchange device 46, from which a pressure difference is calculated. The output voltage may be measured by a technician with conventional instruments, such as a voltmeter. There is a known relationship in the form of a curve 50 (FIG. 7) between flow rate (CFM) and the output voltage that may be provided graphically and accessible to the technician, e.g., positioned on an inside surface of a panel (not shown) of enclosure 22. For example, for a single sensor 48, the voltage signal is representative of a flow rate (CFM) of air 36 or air 44, versus at least two sensors 48, in which each sensor 48 of the at least two sensors 48 outputs a voltage signal from which a voltage difference is calculated and from which a flow rate of air 36 or air 44 is then calculated. With this information, a technician can easily independently adjust or selectively control the flow rate (CFM) of psychrometrically controlled air 36 and non-psychrometrically controlled air 44 in enclosure 22 by adjusting the speed of an associated turbomachine 52 dedicated for use with each of air 36, 44 for increasing the pressure of the air 36, 44 until the output voltage corresponding to the desired flow rate (CFM) is achieved.

Figure 7:
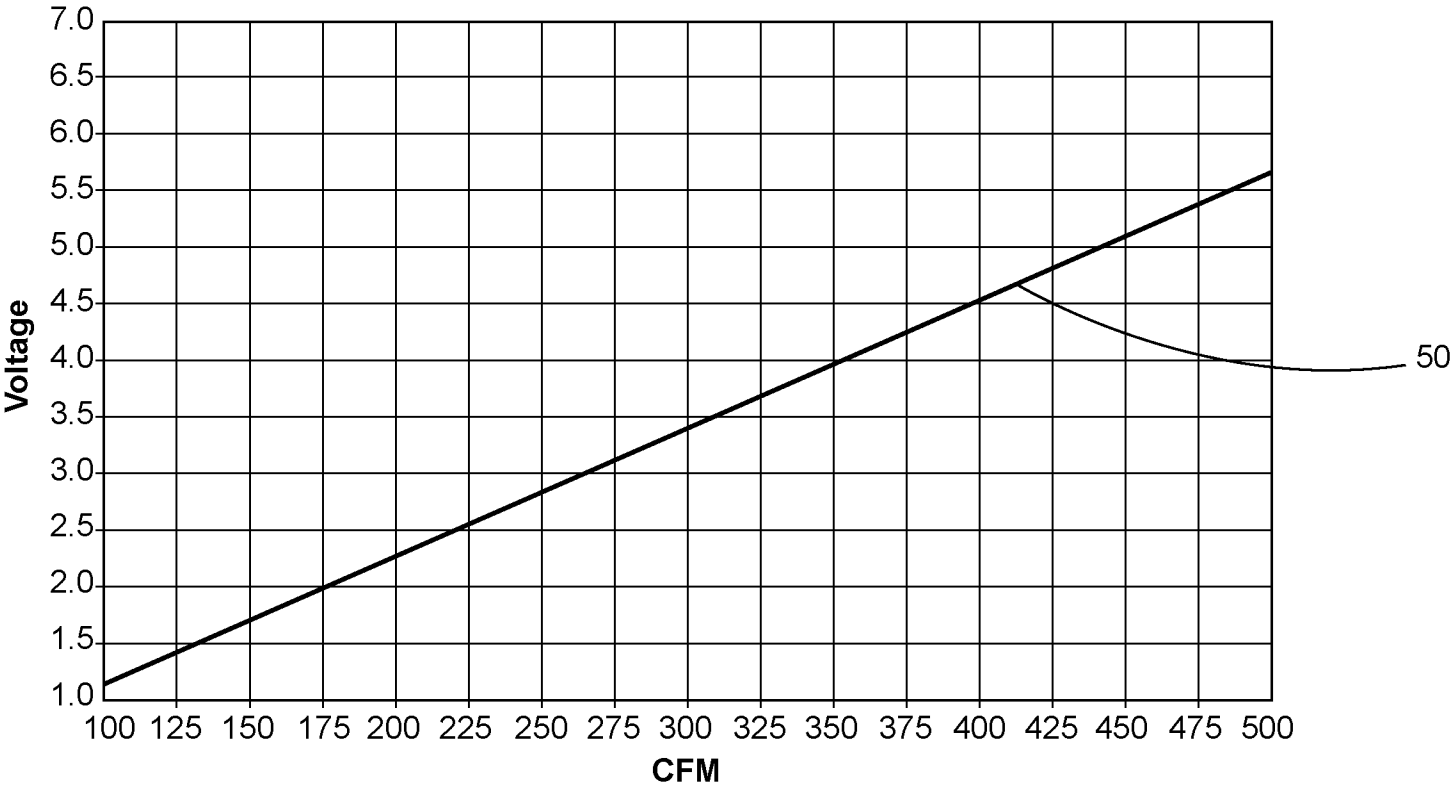
FIG. 7 is a diagram of an exemplary relationship between an airflow stream and a pressure sensor output voltage in an exemplary air system.

For purposes of illustration, if a desired flow rate is 350 CFM, a technician (not shown) utilizing curve 50 (FIG. 7) would note that 350 CFM corresponds to a sensor 48 output voltage (or a sensor 48 output voltage difference, if at least two sensors 48 are utilized) of approximately 3.9 V. With air system 10 operating, the technician would attach a voltmeter to leads in the control panel (not shown) corresponding to sensor(s) 48 and adjust the speed of the associated turbomachine 52, such as by adjusting the input voltage to the turbomachine 52, until the voltmeter indicates 3.9 V. This capability results in significant time savings for the technician during an installation. In one embodiment, as shown in FIG. 7, curve 50 is linear, corresponding to a laminar flow regime of air 36, 44, more easily permitting a technician to correlate a flow rate (CFM) from an output voltage. In one embodiment, curve 50 may be non-linear, correlating to a non-laminar flow regime of air 36, 44. While an exemplary range of flow rate between 100 and 500 CFM and voltage values between 1.0 and 7.0 V are depicted in FIG. 7, these ranges are not intended to be limiting.

It is to be understood that while only one curve 50 is shown in FIG. 7, in one embodiment, two separate and independent curves may be utilized if the corresponding relationships between flow rate (CFM) and the output voltage of psychrometrically controlled air 36 and non-psychrometrically controlled air 44 are different from one another.

In one embodiment, the sensor output voltage is directly accessible via a display (not shown), not requiring a technician to carry a voltmeter to measure the sensor output voltage, also permitting independent flow rate (CFM) adjustability of each of psychrometrically controlled air 36 and non-psychrometrically controlled air 44 in enclosure 22. In one embodiment, a well known microprocessor control system 11 calculates and directly displays flow rate (CFM), also permitting independent flow rate (CFM) adjustability of each of psychrometrically controlled air 36 and non-psychrometrically controlled air 44 in enclosure 22.

Referring back to FIG. 2, once psychrometrically controlled air 36 enters enclosure 22 via inlet 30 and non-psychrometrically controlled air 44 enters enclosure 22 via inlet 38 in a direction opposite psychrometrically controlled air 36 and exchange energy in energy exchange device 46, non-psychrometrically controlled air 44 is directed by turbomachine 52 to exchange energy with energy exchange device 54 for exchanging energy with closed refrigerant loop 70 (FIG. 4) before exiting or being removed from enclosure 22. In one embodiment, turbomachine 52 may be positioned anywhere along the flow path of non-psychrometrically controlled air 44 between inlet 38, energy exchange device 46, energy exchange device 54, and outlet 40, including being at least partially exterior of enclosure 22, such as extending exterior of enclosure 22 near inlet 38 or outlet 40, so long as such positioning does not require disassembly of turbomachine 52 from enclosure 22 in order to permit insertion of enclosure 22 through opening 12 (FIG. 1) as previously discussed.

As further shown in FIG. 2, once psychrometrically controlled air 36 enters enclosure 22 via inlet 30 and non-psychrometrically controlled air 44 enters enclosure 22 via inlet 38 in a direction opposite psychrometrically controlled air 36 and exchange energy in energy exchange device 46, psychrometrically controlled air 36 is directed by turbomachine 52 to flow into a compartment 56 positioned upstream of an energy exchange device 60 and then through a region 58 of energy exchange device 60 defining a first pass 62 through energy exchange device 60. In one embodiment, energy exchange device 60 is positioned in or along enclosure 22. After completing first pass 62, psychrometrically controlled air 36 exits energy exchange device through a region 64, entering a compartment 66 that directs psychrometrically controlled air 36 through an energy exchange device 68 for exchanging energy with refrigerant loop 70 (FIG. 4) before re-entering energy exchange device 60 through a region 72 defining a second pass 74 through energy exchange device 60. As a result, energy is non-mixingly exchanged between first pass 62 and second pass 74 of the psychrometrically controlled air 36 flowing through energy exchange device 60. After completing second pass 74, psychrometrically controlled air 36 exits energy exchange device 60 through a region 76, entering a compartment 78 that directs psychrometrically controlled air 36 through an energy exchange device 80 for exchanging energy with refrigerant loop 70 (FIG. 4) before psychrometrically controlled air 36 exits enclosure 22 via outlet 32. In one embodiment, energy exchange device 80 is positioned in or along enclosure 22.

In one embodiment, turbomachine 52 may be positioned anywhere along the flow path of psychrometrically controlled air 36 between inlet 30, energy exchange device 46, energy exchange device 60, energy exchange device 68, energy exchange device 80 and outlet 32, including being at least partially exterior of enclosure 22, such as extending exterior of enclosure 22 near inlet 30 or outlet 32, so long as such positioning does not require disassembly of turbomachine 52 from enclosure 22 in order to permit insertion of enclosure 22 through opening 12 (FIG. 1) as previously discussed.

Figure 4:
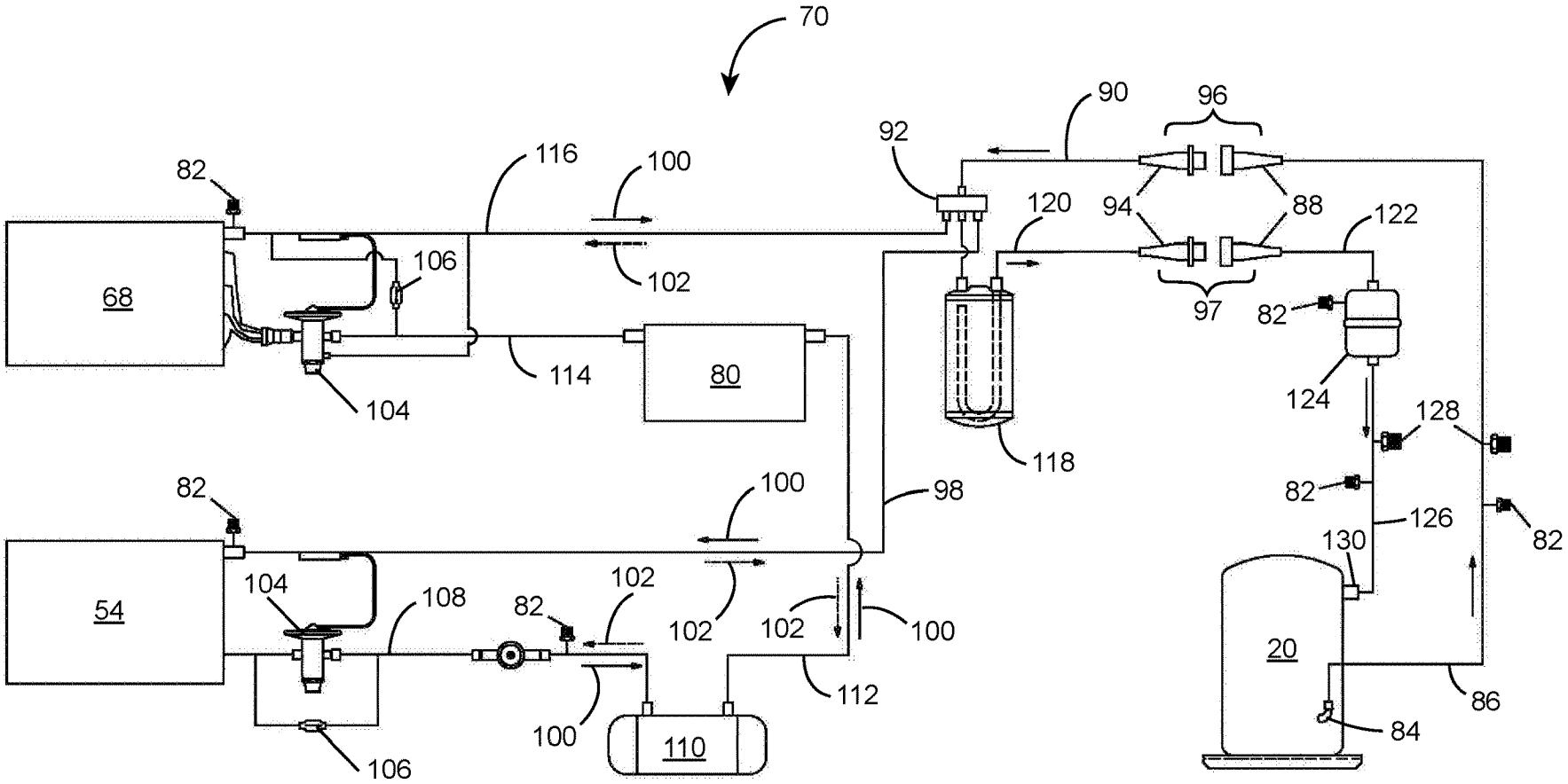
FIG. 4 is a diagram of an exemplary closed refrigerant loop.

FIG. 4 is a diagram of an exemplary closed refrigerant loop 70 for use in the air system 10 (FIG. 1). Components, such as refrigerant service ports 82, expansion device(s) 104, and check valves 106 are shown in FIG. 4, but not further discussed herein unless pertinent to the invention. Compressor 20 compresses a refrigerant vapor and delivers the vapor from a port 84 through a tube 86 that is threadedly engaged with a fitting 88 at an end of tube 86 opposite port 84. A tube 90 extends between a reversing valve 92 at one end of tube 90 to a fitting 94 that is threadedly engaged at an opposite end of tube 90. The ends of facing or corresponding fittings 88, 94 when threadedly engaged form a fitting pair 96. Compressor 20 can be any suitable type of compressor, e.g., centrifugal compressor, reciprocating compressor, screw compressor, scroll compressor, etc. When operating to provide cooling to psychrometrically controlled air 36 (FIG. 2), reversing valve 92 is configured to deliver refrigerant through tube 98 to energy exchange device 54, operating as a condenser in the cooling mode for exchanging energy with non-psychrometrically controlled air 44 (FIG. 2). The flow path of refrigerant for providing cooling to psychrometrically controlled air 36 is shown by directional arrows 100, and the flow path of refrigerant for providing heating to psychrometrically controlled air 36 is shown by directional arrows 102.

Returning to FIG. 4 for operation of refrigerant loop 70 in cooling mode, once refrigerant has flowed through energy exchange device 54 for exchanging energy with non-psychrometrically controlled air 44 (FIG. 2) and is at least partially condensed, the at least partially condensed refrigerant flows through tube 108 before flowing through optional vessel 110, sometimes referred to as a liquid receiver. After flowing through vessel 110, refrigerant flows through tube 112 and then through an optional (in cooling mode) energy exchange device 80, sometimes referred to as a reheat coil, for exchanging energy with second pass 74 (FIG. 2) psychrometrically controlled air 36 (FIG. 2) flowing through energy exchange device 60. After flowing through energy exchange device 80, refrigerant then flows through expansion device 104 which greatly lowers the temperature and pressure of the refrigerant before entering energy exchange device 68, sometimes referred to as an evaporator. Refrigerant exchanges energy with first pass 62 psychrometrically controlled air 36 (FIG. 2) flowing around energy exchange device 68, becoming vapor refrigerant that flows through tube 116 to reversing valve 92, and then flows through an optional vessel 118, sometimes referred to as an accumulator. The vapor refrigerant then flows from vessel 118 through tube 120 that is threadedly engaged with a fitting 94 at an end of tube 120 opposite vessel 118. A tube 122 extends between an optional filter 124 at one end of tube 122 to a fitting 88 that is threadedly engaged at an opposite end of tube 122. The ends of facing or corresponding fittings 88, 94 when threadedly engaged form a fitting pair 97. The vapor refrigerant then flows from filter 124 through a tube 126, returning the vapor refrigerant to a port 130 of compressor 20 to complete the refrigerant loop 70.

Returning to FIG. 4, operation of refrigerant loop 70 in a heating mode is now discussed, beginning at reversing valve 92. That is, when reversing valve 92 is operating to provide heating to psychrometrically controlled air 36 (FIG. 2), reversing valve 92 is configured to deliver refrigerant received from tube 90 to tube 116 to energy exchange device 68, operating as a condenser in the heating mode for exchanging energy with first pass 62 psychrometrically controlled air 36 (FIG. 2). In one embodiment, optional check valve 106 positioned in fluid communication between the tubes 114, 116 results in a portion of vapor refrigerant bypassing energy exchange device 68, which further results in energy exchange device 80 receiving superheated refrigerant for exchanging energy with second pass 74 psychrometrically controlled air 36, requiring energy exchange device 80 to essentially become responsible for condensing the refrigerant, raising the condensing pressure compared to what the condensing pressure would have been if energy exchange device 68 had been utilized to condense the refrigerant, which occurs in a conventional heat pump construction. By virtue of utilizing check valve 106 and energy exchange device 80 as described above, energy exchange device 80 operates to additionally cool the refrigerant when operating in cooling mode, thereby improving efficiency, while operating within acceptable limits of the components in heating mode. After refrigerant flows through energy exchange device 80 for exchanging energy with second pass 74 psychrometrically controlled air 36 (FIG. 2), the refrigerant flows through tube 112 to vessel 110 and then through tube 108 to expansion device 104 and to energy exchange device 54 operating as an evaporator in heating mode for exchanging energy with non-psychrometrically controlled air 44 (FIG. 2) before returning the vapor refrigerant through tube 98 to reversing valve 92. After flowing through reversing valve 92, the vapor refrigerant then flows through vessel 118. The vapor refrigerant then flows from vessel 118 through tube 120 that is threadedly engaged with a fitting 94 at an end of tube 120 opposite vessel 118. Tube 122 extends between an optional filter 124 at one end of tube 122 to fitting 88 that is threadedly engaged at an opposite end of tube 122. The ends of facing or corresponding fittings 88, 94 when threadedly engaged form fitting pair 97. The vapor refrigerant then flows from filter 124 through tube 126, returning the vapor refrigerant to port 130 of compressor 20 to complete the refrigerant loop 70.

In one embodiment, energy exchange device 60 may be a heat pipe.

In one embodiment, a single expansion device 104 may be utilized for use with both energy exchange devices 54, 68.

In one embodiment, air system 10 (FIG. 2) may be configured to operate in three different operating modes:

1. Ventilating (turbomachines 52 (FIG. 2)) with simultaneous energy recovery via energy exchange device 46 (with compressor 20 (FIG. 2) as well as associated energy exchange devices 54, 68, 80 (FIG. 2) being non-functional);

2. Ventilating (turbomachines 52 (FIG. 2)) with simultaneous energy recovery via energy exchange device 46 and simultaneous dehumidification as a result of refrigerant flow in refrigerant loop 70 (FIG. 4) in directional arrow 100 (FIG. 4);

3. Ventilating (turbomachines 52 (FIG. 2)) with simultaneous energy recovery via energy exchange device 46 and simultaneous heating as a result of refrigerant flow in refrigerant loop 70 (FIG. 4) directional arrow 102 (FIG. 4).

In one embodiment, air system 10 (FIG. 2) may be configured to operate in less than the three different operating modes, depending upon the application, permitting removal of mode-specific components not used.

Figure 8:
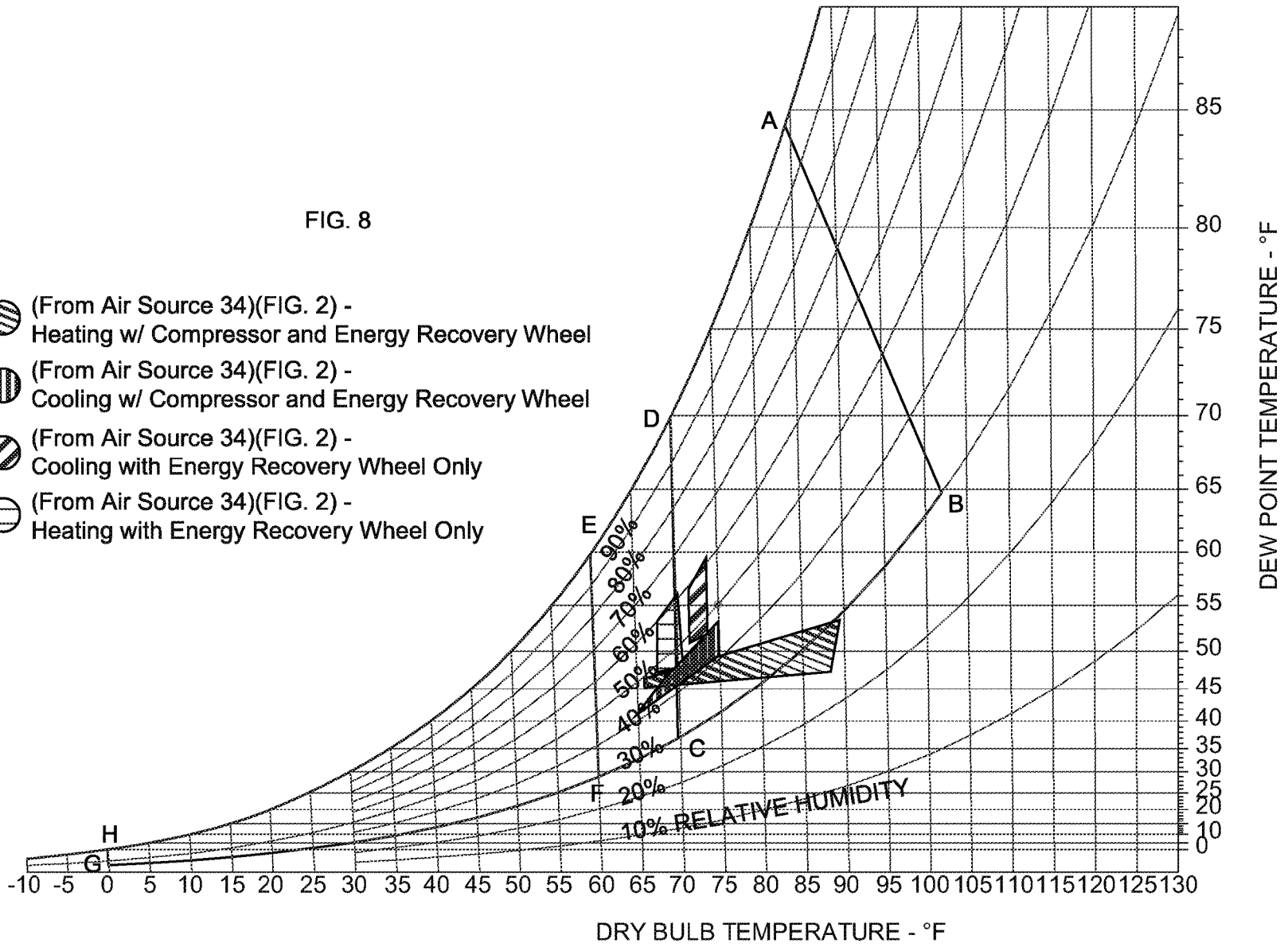
FIG. 8 is a psychrometric chart for an exemplary air source received and processed by an exemplary air system.

FIG. 8 shows a psychrometric chart at sea level at a barometric pressure of 29.921 inches of mercury for an exemplary air source 34 (FIG. 2) received and processed by an exemplary air system of the present invention. That is, air source 34 (FIG. 2) may be received by the air system in any combination of dry bulb temperatures between 0-103° F. and between 30-100 percent relative humidity as encompassed by region ABGH. Within region ABGH are subregions EFGH, CDEF, and ABCD. Conditions for air source 42 (FIG. 2) are 75° F. dry bulb/62.5° F. wet bulb for cooling, and 70° F. dry bulb/58.5° F. wet bulb for heating. It is to be understood that information contained in FIG. 8 are exemplary and not intended to be limiting. For example, the air system of the present invention will still function for air source 34 (FIG. 2) ranges below 0° F. and above 103° F.

As further shown in FIG. 8, when air source 34 is provided to the air system from subregion EFGH, the air system is in operating mode 3 (see above), with the air system delivering psychrometrically controlled air 36 (FIG. 2) from outlet 32 (FIG. 2) encompassed by the subregion having a cross-hatched region identified as "Heating w/Compressor and Energy Recovery Wheel."

As further shown in FIG. 8, when air source 34 is provided to the air system from subregion ABCD, the air system is in operating mode 2 (see above), with the air system delivering psychrometrically controlled air 36 (FIG. 2) from outlet 32 (FIG. 2) encompassed by the subregion having a cross-hatched region identified as "Cooling w/Compressor and Energy Recovery Wheel."

As further shown in FIG. 8, when air source 34 is provided to the air system from subregion CDEF, the air system is in operating mode 1 (see above, for cooling), with the air system delivering psychrometrically controlled air 36 (FIG. 2) from outlet 32 (FIG. 2) encompassed by the subregion having a cross-hatched region identified as "Cooling with Energy Recovery Wheel Only".

As further shown in FIG. 8, when air source 34 is provided to the air system from subregion CDEF, the air system is in operating mode 1 (see above, for heating), with the air system delivering psychrometrically controlled air 36 (FIG. 2) from outlet 32 (FIG. 2) encompassed by the subregion having a cross-hatched region identified as "Heating with Energy Recovery Wheel Only."

Returning to FIG. 2, the four cross-hatched regions (FIG. 8) provide psychrometrically controlled air 36 from outlet 32 with temperature and humidity ranges controlled more tightly compared to the range of humidity and temperature of air 36 entering enclosure 22 from source 34, similar to conventional, complicated air systems requiring feedback control involving variable operation of multiple components and constant monitoring of many parameters. Importantly, the air system of the present invention only requires monitoring of a single parameter in order to operate properly; the dry bulb temperature of the psychrometrically controlled air 36. That is, it is only required that the dry bulb temperature of the psychrometrically controlled air 36 be periodically measured from a location between air source 34 exterior of enclosure 22 and upstream of energy exchange device 60, e.g., compartment 56, for the air system to operate properly, even when the air system further comprises energy exchange device 80 positioned in or along enclosure 22 for exchanging energy between the psychrometrically controlled air 36 and refrigerant loop 70. It is to be understood that refrigerant loop components, including compressor 20, energy exchange devices 54, 68, 46, 68, 80, reversing valve 92, check valves 106, expansion devices 104 previously discussed also operate as previously discussed without requiring more than the dry bulb temperature of the psychrometrically controlled air 36.

In one embodiment, a second, independently operated air system may be used in combination with the air system of the present invention, if desired.

Figure 5:
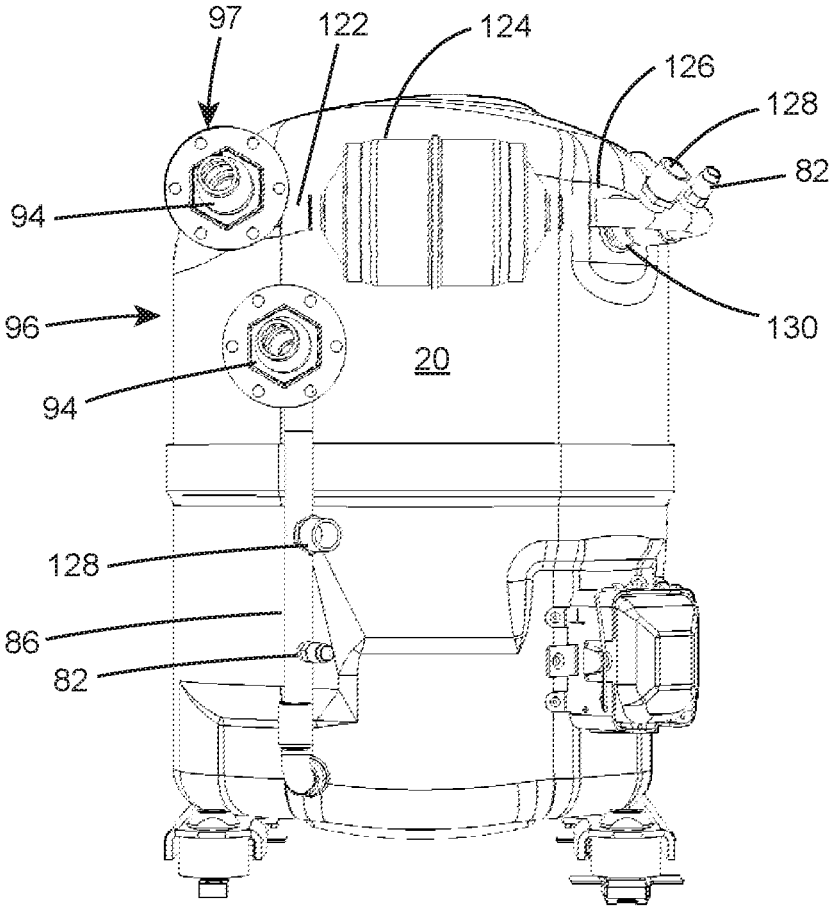
FIG. 5 is an elevation view of an exemplary compressor.
Figure 6:
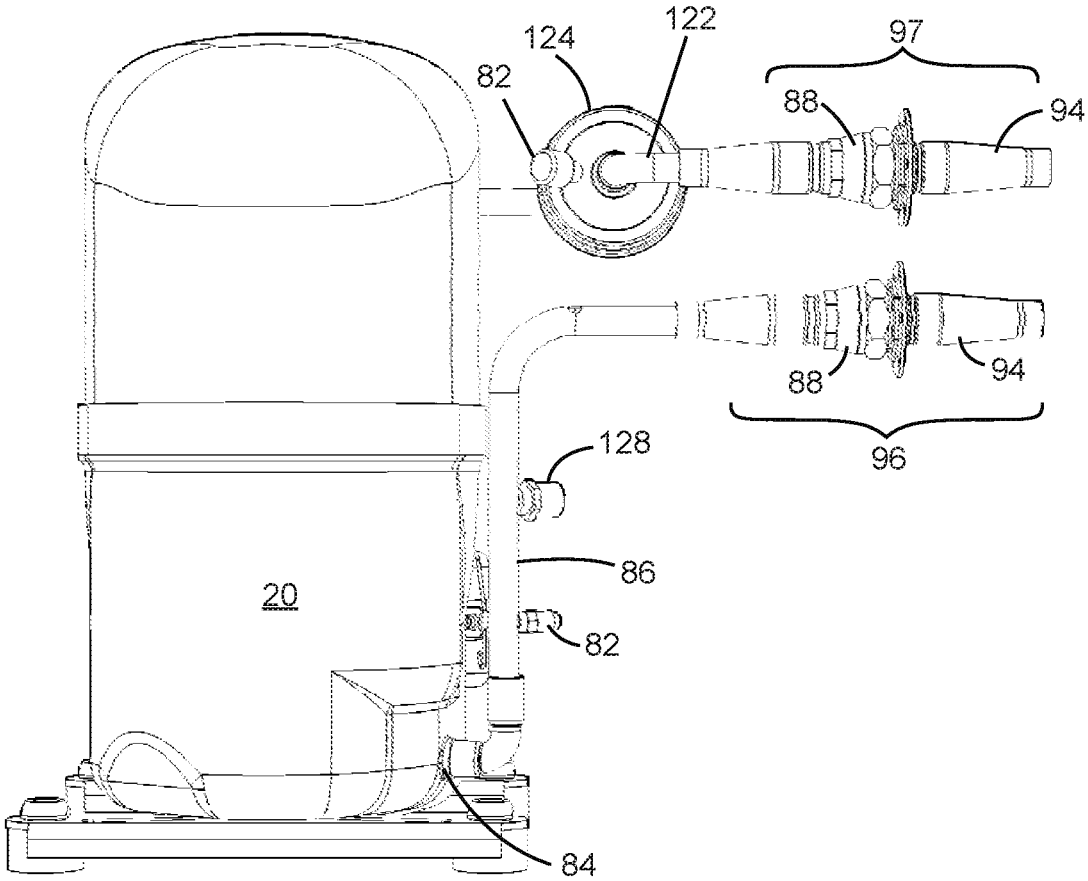
FIG. 6 is an elevation view of the compressor of FIG. 5 rotated 90 degrees about a vertical axis.

Referring now to FIGS. 4-6 collectively, compressor 20 and associated fitting pairs 96, 97 are now discussed. As shown schematically in FIG. 4, compressor 20 compresses a refrigerant vapor and delivers the vapor from a port 84 through a tube 86 that is threadedly engaged with a fitting 88 at an end of tube 86 opposite port 84. A tube 90 extends between a reversing valve 92 at one end of tube 90 to a fitting 94 that is threadedly engaged at an opposite end of tube 90. The ends of facing or corresponding fittings 88, 94 when threadedly engaged form fitting pair 96. An opposite portion of a suction side of refrigerant loop 70 includes vapor refrigerant flowing from vessel 118 through tube 120 that is threadedly engaged with a fitting 94 at an end of tube 120 opposite vessel 118. A tube 122 extends between an optional filter 124 at one end of tube 122 to a fitting 88 that is threadedly engaged at an opposite end of tube 122. The ends of facing or corresponding fittings 88, 94 when threadedly engaged form a fitting pair 97. The vapor refrigerant then flows from filter 124 through a tube 126, returning the vapor refrigerant to a port 130 of compressor 20 to complete the refrigerant loop 70.

In one embodiment, port 84 may be directly threadedly connected to fitting 88. In one embodiment, port 130 may be directly threadedly connected to fitting 88.

The fittings 88, 94, such as Series 5505 fittings manufactured by Parker Hannifin headquartered in Cleveland, Ohio, of respective fitting pairs 96, 97 are adapted to be repeatably, e.g., at least twice, threadedly connected and disconnected to/from each other. When fittings 88, 94 are threadedly connected, the resulting fitting pairs 96, 97 form a fluid tight seal to prevent refrigerant flow therethrough, i.e., preventing leakage of refrigerant from between the fittings 88, 94. Additionally, when fittings 88, 94 are threadedly disconnected from one another, each disconnected side of fittings 88, 94 fitting forming a fluid tight seal preventing refrigerant flow therethrough. Stated another way, the disconnected fittings are self-sealing. In other words, during service, fitting pairs 96, 97 may be opened without loss of refrigerant, allowing compressor 20 to be removed without evacuating refrigerant and un-brazing refrigeration tubing. Compressor 20 may be pre-charged with refrigerant using service ports 128, which service ports 128, in one embodiment, may be re-sealed after charging the compressor.

As a result of fitting pairs 96, 97, compressor 20 can be replaced inside of a sealed refrigerant loop 70 without the requirement of an open flame or other high temp (>600° F.) heating process, such as solder or braze, in addition to not requiring refrigerant recovery and evacuation.

The compressor is arguably, the largest and most complex device to have a possibility of failure in a refrigeration system. A typical compressor replacement requires several (common to all refrigeration circuits) processes to occur by international, national, local and some safety policies. Currently, these processes minimally include the following steps currently if a compressor has failed.

First, the refrigerant from the refrigeration circuit must be recovered using specialty tools that must be approved by the Environmental Protection Agency (EPA), and EPA licensed technicians must also follow strict EPA rules while recovering the refrigerant. This process requires a minimum of a recovery cylinder, a refrigeration gauge set, a recovery machine, and the associated additional hoses or lines or tubes typically required to tie all of these components and the refrigeration circuit in need of repair together.

Second, the compressor must be removed from the circuit. Once the refrigerant is recovered and there is no additional refrigerant inside the system, the compressor can be removed. Some compressors may have what is commonly referred to as "roto-lock" fittings. A roto lock fitting may be mounted directly on a compressor and allows for removal of the compressor without a brazing torch. However, the components described as "roto-locks" are not self-sealing, and once the compressor is removed, the entire refrigeration system is subject to refrigerant leakage to the atmosphere.

If there are no "roto-locks" available on the compressor, the compressor must be removed via an open flame torch, at minimal using a gas such as methylacetylene-propadiene propane (MAPP) gas and usually with an oxyacetylene torch kit. In order to braze safely and to follow EPA and typically unit manufacturers suggestions, nitrogen must be blown through the system where brazing is occurring to remove oxygen from the brazing area preventing oxidation during the heating process. The act of "sweating"/brazing a compressor out of a unit requires at minimal a torch kit of various types, nitrogen bottle or other inert gas that prevents oxidation. Normally many local codes and building ownership safety guidelines exist, that also require the following, a fire extinguisher placed within 6 feet of the technician, as well as a second person known as the "fire watch". The "fire watch" is dedicated additional personnel whose sole task is to oversee from a reasonable distance and at minimum in the same room and in sight as the technician performing the brazing, to look for any flames that may be catching flammable media of any type on fire. Depending on codes or most building safety guidelines, the "fire watch" must actually be holding a fire extinguisher. This provides improved response time and ability to divert a fire hazard if a fire is in its earliest stages.

Once the compressor is removed the same brazing and nitrogen procedure is used to install the new compressor.

Once the new compressor is installed the technician typically performs a leak test, which per EPA guidelines, requires a pressure of nitrogen or other inert gas to be pressurized to manufacturer specifications in the system for 20 minutes to 30 minutes and review if the pressure has dropped since time of pressurization.

The technician must use another EPA approved device referred to as a vacuum pump. The system must be evacuated for a recommended minimum of a half-hour and must achieve a vacuum of 500 microns or below vacuum. This is measured by a (generally observed as required) tool referred to as a micron gauge.

Once the unit has achieved and held the sufficient vacuum, the system can be recharged with refrigerant. The technician must use a refrigerant scale, and a bottle of the specified equipment's refrigerant to achieve the desired charge.

The pre-charged compressor of the present invention in the field only requires loosening or threadedly disconnecting fittings 88, 94 from fitting pairs 96, 97 in order to disconnect the failed compressor 20 from the system.

The new compressor 20 can then be placed in location tied into the system by threadedly connecting fittings 88, 94 to form fitting pairs 96, 97. No recovery machine, no nitrogen, no brazing, no pressure test, no evacuation, and no charging are required. There is virtually no refrigerant release.

A conventional compressor replacement process is commonly quoted at 6-8 labor hours. However, a replacement of the compressor of the present invention requires about 20 minutes, with none of the specialized equipment discussed above.

In one embodiment, any one or all of energy exchange devices 54, 68, 80, expansion device(s) 104, vessels 110, 118, filter 124 may be threadedly connected to refrigerant loop 70 by fittings 88, 94 of fitting pairs 96, 97.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An air system comprising:

an enclosure;

a compressor, a first energy exchange device, an expansion device, and a second energy exchange device each positioned in or along the enclosure and connected in a closed refrigerant loop;

a first inlet formed in the enclosure for receiving air from a first source, the air received from the first source being psychrometrically controlled in the enclosure;

a first outlet formed in the enclosure for removing the psychrometrically controlled air from the enclosure;

a second inlet formed in the enclosure for receiving air from a second source, the air received from the second source being non-psychrometrically controlled in the enclosure;

a second outlet formed in the enclosure for removing the non-psychrometrically controlled air from the enclosure; and a third energy exchange device positioned in or along the enclosure for exchanging energy between the psychrometrically controlled air and the non-psychrometrically controlled air;

wherein the enclosure is adapted for insertion through an opening having opposed parallel sides having a dimension of 36 inches or less.

2. The air system of claim 1 further comprises a fourth energy exchange device positioned in or along the enclosure for non-mixingly exchanging energy between a first flow pass and a second flow pass of the psychrometrically controlled air flowing through the second energy exchange device.

3. The air system of claim 2, wherein during operation of the air system, only a dry bulb temperature of the psychrometrically controlled air is measured from a location between the first source exterior of the enclosure and upstream of the fourth energy exchange device, the air system further comprising a fifth energy exchange device positioned in or along the enclosure for exchanging energy between the psychrometrically controlled air and the refrigerant loop.

4. The air system of claim 1, wherein the second energy exchange device exchanges energy between the psychrometrically controlled air and the refrigerant loop.

5. The air system of claim 1 further comprises a fifth energy exchange device positioned in or along the enclosure for exchanging energy between the psychrometrically controlled air and the refrigerant loop.

6. The air system of claim 1, wherein the first energy exchange device exchanges energy between the non-psychrometrically controlled air and the refrigerant loop.

7. The air system of claim 1 further comprises a first turbomachine for increasing the pressure of the psychrometrically controlled air in the enclosure.

8. The air system of claim 1 further comprises a second turbomachine for increasing the pressure of the non-psychrometrically controlled air in the enclosure.

9. The air system of claim 1 further comprises a sensor for measuring a pressure difference, or at least two sensors for each measuring a pressure from which a pressure difference is calculated of one of the psychrometrically controlled air or the non-psychrometrically controlled air at predetermined positions in the enclosure, the sensor outputting a voltage signal representative of a flow rate, or each sensor of the at least two sensors each outputting a voltage signal from which a voltage difference is calculated and from which a flow rate is calculated of the one of the psychrometrically controlled air or the non-psychrometrically controlled air, wherein the flow rate is selectively controllable in response to selectively controlling a voltage provided to a corresponding turbomachine for increasing the pressure of the psychrometrically controlled air or the non-psychrometrically controlled air in the enclosure.

10. The air system of claim 9, wherein the flow rate of the one of the psychrometrically controlled air or the non-psychrometrically controlled air corresponds to a non-laminar flow regime or a laminar flow regime.

11. The air system of claim 1, where the second energy exchange device is a heat pump.

12. The air system of claim 1 further comprising a pair of fittings threadedly connectable to one another and in fluid communication with the refrigerant loop, the pair of fittings adapted to be repeatably threadedly disconnected from one another;

in response to the pair of fittings being threadedly disconnected from one another, each fitting forming a fluid tight seal preventing refrigerant flow therethrough.

13. The air system of claim 12, wherein each fitting is threadedly connectable to the refrigerant loop or a component in fluid communication with the refrigerant loop.

14. The air system of claim 13, wherein the component is taken from the group consisting of the compressor, the first energy exchange device, the expansion device, the second energy exchange device, a fourth energy exchange device, a fifth energy exchange device, a reversing valve, a first vessel, a second vessel and a filter.

15. The air system of claim 1, wherein the third energy exchange device exchanges both sensible energy and latent energy, or only exchanges only sensible energy between the psychrometrically controlled air and the non-psychrometrically controlled air.

16. The air system of claim 1, wherein the third energy exchange device is a heat pipe, an enthalpy wheel or a sensible wheel.

17. An air system comprising:

an enclosure;

a compressor, a first energy exchange device, an expansion device, and a second energy exchange device each positioned in or along the enclosure and connected in a closed refrigerant loop;

a first inlet formed in the enclosure for receiving air from a first source, the air received from the first source being psychrometrically controlled in the enclosure;

a first outlet formed in the enclosure for removing the psychrometrically controlled air from the enclosure;

a second inlet formed in the enclosure for receiving air from a second source, the air received from the second source being non-psychrometrically controlled in the enclosure;

a second outlet formed in the enclosure for removing the non-psychrometrically controlled air from the enclosure; and a third energy exchange device positioned in or along the enclosure for exchanging energy between the psychrometrically controlled air and the non-psychrometrically controlled air;

wherein the enclosure having a cross section having outside dimensions of less than 36 inches in two perpendicular directions.

* * * * *